US006665973B1

(12) United States Patent
Peev

(10) Patent No.: US 6,665,973 B1
(45) Date of Patent: Dec. 23, 2003

(54) STRIKER TRIGGER MECHANISM FOR AUTOMATIC AND SEMI-AUTOMATIC FIREARMS

(76) Inventor: Vladimir Georgiev Peev, "Petko Todorov" blvd., building 7, entrance "V", apartment 53, 1408 Sofia (BG)

( * ) Notice: Subject to any disclaimer, the term of this patent is extended or adjusted under 35 U.S.C. 154(b) by 0 days.

(21) Appl. No.: 10/089,309

(22) PCT Filed: Sep. 27, 1999

(86) PCT No.: PCT/BG99/00018

§ 371 (c)(1),
(2), (4) Date: Mar. 27, 2002

(87) PCT Pub. No.: WO01/23824

PCT Pub. Date: Apr. 5, 2001

(51) Int. Cl.[7] ..... F41A 19/13
(52) U.S. Cl. ..... 42/69.01; 42/69.02
(58) Field of Search ..... 42/69.01, 69.02; 89/140

(56) References Cited

U.S. PATENT DOCUMENTS

| | | | | |
|---|---|---|---|---|
| 3,713,241 A | | 1/1973 | Dieckmann | 42/69 B |
| 3,756,120 A | | 9/1973 | Roy | 89/163 |
| 3,857,325 A | | 12/1974 | Thomas | 89/198 |
| 5,701,698 A | * | 12/1997 | Wesp et al. | 42/69.02 |
| 5,913,261 A | | 6/1999 | Guhring et al. | 89/128 |

FOREIGN PATENT DOCUMENTS

| | | | | |
|---|---|---|---|---|
| AT | 374002 | | 3/1984 | |
| CH | 185452 | | 10/1936 | |
| DE | 3639007 C | * | 1/1988 | ..... F41D/11/04 |
| EP | 0 188 179 | | 2/1985 | |
| FR | 1469300 | | 10/1967 | |
| GB | 16709 | | of 1912 | |

* cited by examiner

*Primary Examiner*—Michael J. Carone
*Assistant Examiner*—Troy Chambers
(74) *Attorney, Agent, or Firm*—Brown & Michaels, PC

(57) ABSTRACT

The mechanism is applicable in military manufacture and is designed to be built in automatic and semi-automatic firearms of the kinds: pistols, machine guns and submachine guns. This mechanism is with simple construction and ensures enhanced over travel security for weapons, no safety, allowing for no accidental shooting to take place. The striker-trigger mechanism consists of a striker mechanism, a trigger mechanism and a fire-selecting mechanism integrated via a rear block (30). The fire selecting mechanism takes the form of a fire select (29). placed behind the breach block (34) with an extractor, and an internal step-like channel (7) centrally located, containing a firing pin (1) with enlargements at both ends, front and rear one respectively. The firing pin (1) has profile tooth (2) protruding outside the breach block (34) meant to engage with the trigger mechanism through a trigger (15) equipped with a return spring (18) and joint-lined to the frame (35). The trigger (15) connects with a profile one-arm lever, made as trigger bar (10) pushed to the breach block (34) by spring (19). The trigger bar (10) has an upper lug surface (11) and a firing tooth (12) to link with the striking mechanism. Between the two enlargements two axially movable spring cups (3 and 5) are separated by the volute firing pin spring (4) coiled around the firing pin (1).

8 Claims, 9 Drawing Sheets

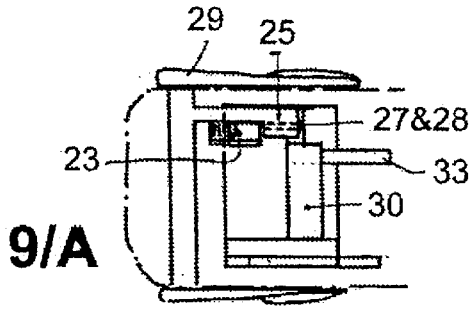
Fig-9
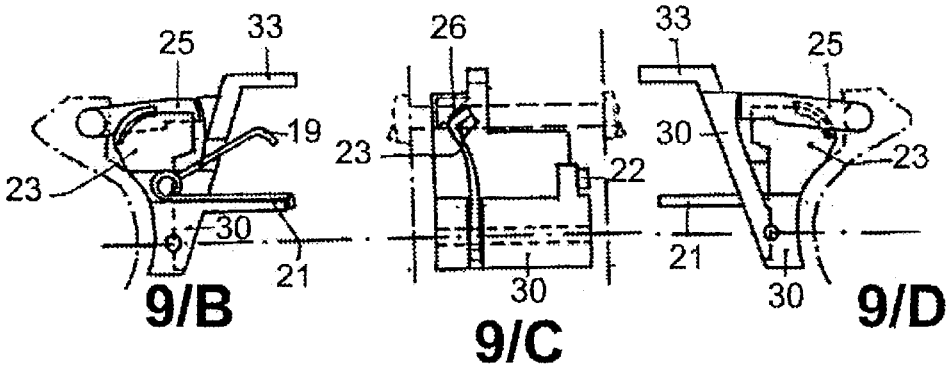
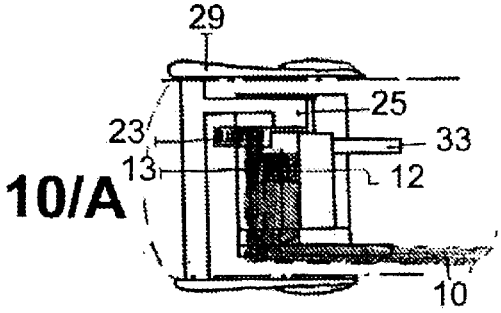
Fig-10
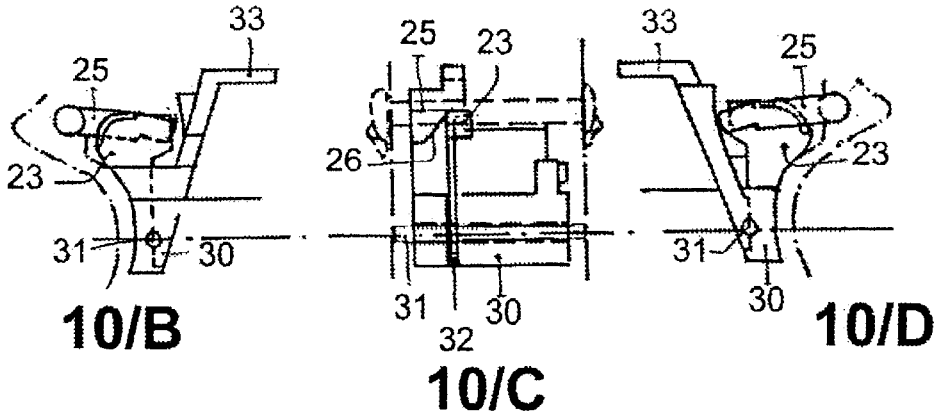

14/A

14/B

14/C

STRIKER TRIGGER MECHANISM FOR AUTOMATIC AND SEMI-AUTOMATIC FIREARMS

FIELD OF THE INVENTION

This self-loading striker-trigger mechanism is meant to be built in automatic and semi-automatic firearms of the kinds: pistols, machine guns and submachine guns for automatic and semi-automatic fire.

BACKGROUND OF THE INVENTION

Known striker-trigger mechanisms for building in handguns fall into two major types:

The first type are striker-trigger mechanisms with a striker. This type of striker-trigger mechanisms involve a hammer mechanism coupled with a trigger mechanism. The hammer mechanism includes a striker interacting with a firing pin spring. Under the impact of the firing pin spring the striker rotates to hit a firing pin (a prolate pin-shaped body), which flies ahead and hits the (primer) capsule of a cartridge in the chamber and executes a shot.

This type of striker-trigger mechanisms come with two kinds of trigger mechanisms—for single— and double-action modes of operation respectively.

With the single-action trigger mechanisms after loading the weapon, that is feeding a cartridge in the chamber of the barrel, the striker can be manually lowered without producing a shot and then manually set into combat position right before the firing.

The double-action trigger mechanisms of the above referred type are applicable in submachine and machine guns. With them the combat position of the striker is achieved through pressing the trigger.

With the submachine guns this known striker-trigger mechanism employs a device for shot separation and safety tools.

With the machine firearms there is also a fire selecting mechanism for automatic and semi-automatic fire.

The weaknesses of this traditional type of striker-trigger mechanisms are:

With the single-action striker-trigger mechanisms to carry the gun in a ready-to-fire state after loading it, the striker has to be manually dropped without firing; and later right before shooting to be manually set into firing position, all of which takes time.

With the double-action striker-trigger mechanisms the striking hammer is put into firing position by means of pulling the trigger. The first shot, then, requires prolonged and heavy motion of trigger, unlike second and subsequent shots fired by brisk and smooth trigger motion. That forces the user into getting accustomed to two kinds of trigger motions—the long and heavy one causes deviation and accuracy reduction.

The second type is a single-action striker-trigger mechanism employing a firing pin in direct link with a firing pin spring, which is either coiled around it or placed behind it. In this kind of striker-trigger mechanisms the firing pin gets into combat position, firing pin spring cocked, simultaneously with loading the gun, i.e. with issuing a cartridge into the chamber.

A shortcoming of this known type of mechanism is that carrying the gun ready-to-fire, the spring is exerted all the time, which leads to its fatigue over time, while a major requirement for modern firearms in military or law-enforcement use, is to allow to be carried for a long time without depreciation being caused to their mechanics.

TECHNICAL SUMARY OF THE INVENTION

The invention aims at devising a self-loading striker-trigger mechanism for semi-automatic and automatic fire featuring simple construction and enhanced security upon carrying the firearms loaded no safety, capable of eliminating any possibility of accidental discharge, and with the trigger motion smooth and equally long for each shot in automatic or semi-automatic fire modes.

The solution to the task is a self-loading striker-trigger mechanism for machine guns and submachine guns, which consists of a striker mechanism, trigger mechanism and a fire selecting mechanism for switching from automatic to semi-automatic fire. The striker mechanism includes a firing pin fixed in a breach block mounted in the upper rear end of the frame of the firearm. The firing pin has a pointed front end with a firing pin spring coiled around it. The trigger mechanism mounted below has a trigger to set firing pin into combat position. As per this invention the striker mechanism, the trigger mechanism and the fire selecting mechanism have been put together in a single unit in the form of a rear block. The fire selecting mechanism is accomplished as a fire select placed in the rear part of the frame. Inside the rear central part of the breach block longitudinally a step-like channel has been run to house the firing pin fitted with a profile tooth, designed to mesh with the trigger mechanism, whose trigger is equipped with a spring to push the trigger back. The trigger is joint-linked to the frame. Again joint-linked to the trigger comes a profile one-arm lever in the form of a trigger bar, pressed to the breach block by another spring. The trigger bar has a contact firing tooth with the striking mechanism, coming as an upper lug sideways to the trigger bar.

Optionally the self-loading striker-trigger mechanism for machine and submachine firearms, as per this invention, can be realized with the striker mechanism having enlargements at both ends—front and rear enlargements respectively. The lower end of the rear enlargement has the profile tooth engaging with the firing tooth on the trigger mechanism. Both teeth's profiles correspond. Central to the front enlargement of the firing pin is its front pointed end. Between the two enlargements two axially moving spring cups are positioned with external diameters more and internal diameters less than the external diameter of the enlargements, so that their axial movement is restricted by them. The two axially moving cups are separated by the volute firing pin spring coiled around the firing pin, which has a diameter less than the external diameters of the cups, hence holding the cups within their allocated enlargements. The striking mechanism thus shaped as a unit is mounted, along the same axis as the gun's barrel, in the step-like lidded channel in the rear central area of the breach block, with front and rear props to space the axial movement of the movable cups.

Another optional realization of the self-loading striker-trigger mechanism for machine and submachine firearms, as per this invention, features a lengthwise cut-out in the lower rear part of the step-like channel of the breach block, parallel to its longitudinal axis, holding the profile tooth to the rear enlargement of the firing pin so that it protrudes outside the longitudinal cut-out. The step-like channel is constricted in its front part and shapes a step-like tightening, whose foremost surface is the front prop for the spring cup in extreme foremost position. The front part of the step-like aperture has minimal diameter for the front pointed end of the firing pin to come in; while in its rear part, maximal in diameter, rests stationary the rear prop for the movable cup in the form of sleeve. In the longitudinal cut-out area the sleeve has a lengthwise fuller as wide as the longitudinal cut-out in the step-like channel and fitting so that the tooth of the firing pin be able to move freely along its longitudinal axis. Sleeve's outside diameter equals the diameter of the rearmost, widest part of the step-like channel, while the inside diameter of the sleeve is a little larger than the rear enlargement of the firing pin, so that it can move freely along and the firing pin can move unhindered along the axis.

A possible realization under this invention of the self-loading striker-trigger mechanism for machine and submachine firearms works with the sleeve stationary—fixed in the rear part of the step-like channel in the breach block by means of a fixing tooth.

A possible realization under this invention of the self-loading striker-trigger mechanism for machine and submachine firearms optionally has the firing pin tooth with a flat front surface/area square to the axis of the firing pin and rear surface/area slanting to this axis; while the firing tooth is with flat rear surface, also square to the axis of the firing pin and slanting front surface corresponding with the slanting surface of the firing pin tooth.

Another option for realization of the self-loading striker-trigger mechanism for machine and submachine firearms works with the spring of the trigger mechanism, made of spring wire, around a stationary axle mounted to the rear block. One arm of this spring presses the lower part of the trigger bar, parallel to the axis of the firing pin, to fall within a longitudinal groove made there for it; and below the second arm of the spring there is a support, part of the rear block, parallel to the axis of the firing pin, so that the spring presses the trigger bar upwards to the inside of a ramp-channel with slanting rear surface made in the lower rear part of the breach block, parallel to the axis of the firing pin.

The self-loading striker-trigger mechanism for machine and submachine firearms under the object of this invention can be realized with the trigger i suspending from an axle attached to the frame and passing through a canal made in its upper part. The front foremost surface of the above mentioned upper part upholds the helical spring for trigger return, coiled around the axle. The upper part of the trigger has a second axle set up, which fits with the trigger bar in a bearing in the upper rear part, where the arcuated lug lies and the firing tooth situated in the rearmost surface of the trigger bar. The trigger bar will have to employ a tooth to be spring-retained—spring provided in the rear block.

The self-loading striker-trigger mechanism for machine and submachine firearms, as per this invention, would preferrably be accomplished so that the rear block is positioned in the upper rear part of the frame having the fire select connected by means of an arm with tilting inside surface propping the upper bent end of the spring retention, whose second end fits in a cut-out in the rear part of the rear block. The arm of the fire select fits (bearing) with a stationary axle in the rearmost part of the frame and is in contact with a fixing pin and a spring.

The advantages of the self-loading striker-trigger mechanism as proposed by this invention will be as follows:

This mechanism features a simple structure and its operation disnecessitates the safety as unintentional shots are prevented from going off, eliminated by the design of the striker and trigger mechanisms engaging through their teeth with matching profiles.

Also advantageous is the possibility to carry the gun loaded, since the firing pin spring is cocked directly and only by pulling the trigger. No less a contribution to the existing level of technology in terms of facilitated utilization, is the fact that the self-loading striker-trigger mechanism's configuration implies rectilinear movements of the trigger, smooth and equally long for all shots. Accidental discharge is impossible with it, since the the firing tooth of the trigger bar within the trigger mechanism is positioned before the tooth of the firing pin, hence functions as safety. Thus a shot cannot be fired.

BRIEF DESCRIPTION OF THE DROWINGS

An example of an optional realization of the self-loading striker-trigger mechanism, as per this invention is demonstrated in the figures supplemented, of which:

FIG. 1 represents a vertical section view of a gun with a self-loading striker-trigger mechanism, stationary.

FIG. 2 gives a side view of a machine firearm with a partial section through the self-loading striker-trigger mechanism with trigger pulled to its aftermost position immediately before a shot will be fired.

FIG. 3 illustrates a partial vertical section of part of the machine firegun through the self-loading striker-trigger mechanism while firing a shot.

FIG. 4 gives a side view of the machine gun with a partial vertical section through the self-loading striker-trigger mechanism the instant after a shot has been fired.

FIG. 5 is a partial vertical section of part of the machine gun through the self-loading striker-trigger mechanism in moving the breach block ahead with a new cartridge fed in.

FIG. 9/A represents a view from above of the fire select in upper position of device in automatic fire mode.

FIG. 9/B is a right-hand side view of the fire select mechanism in upper position of device in automatic fire mode.

FIG. 9/C shows a back view of the fire select mechanism in upper position of device in automatic fire mode.

FIG. 9/D is a left-hand view of the fire select mechanism in upper position of device in automatic fire mode.

FIG. 10/A represents a view from above of the fire select in lower position of device in semi-automatic fire mode.

FIG. 10/B is a right-hand side view of the fire select mechanism in lower position of device in semi-automatic fire mode.

FIG. 10/C shows a back view of the fire select mechanism in lower position of device in semi-automatic fire mode.

FIG. 10/D is a left-hand view of the fire select mechanism in lower position of device in semi-automatic fire mode.

Figure 11:
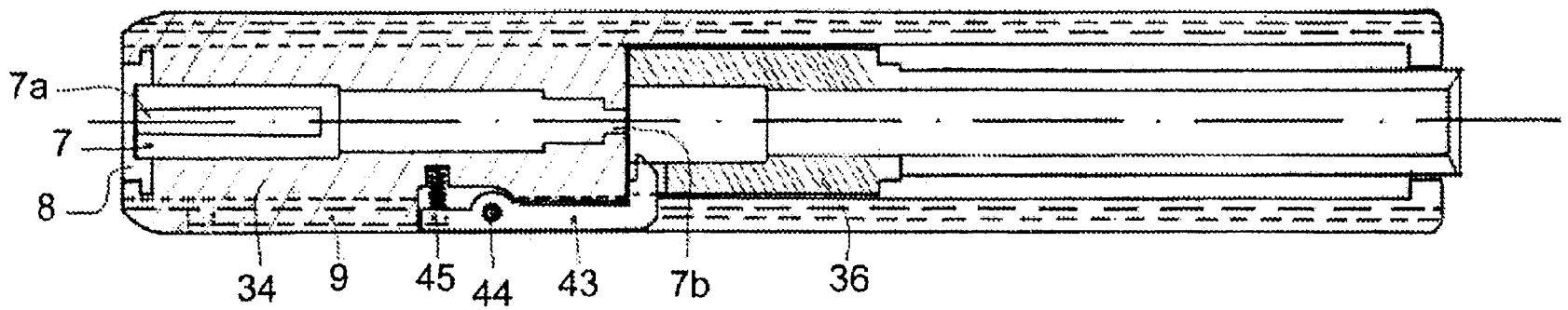

FIG. 11 displays a horizontal section through the breach block showing the channel of the self-loading striker-trigger mechanism.

Figure 12:
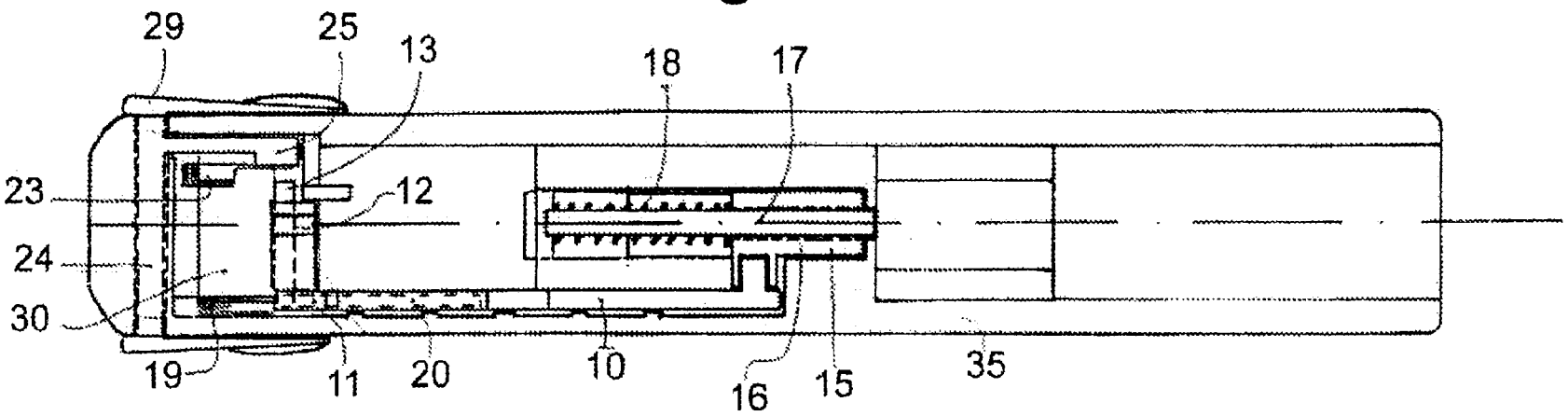

FIG. 12 is a view from above, breach block disassembled, with a trigger mechanism set up in the frame.

Figure 13:
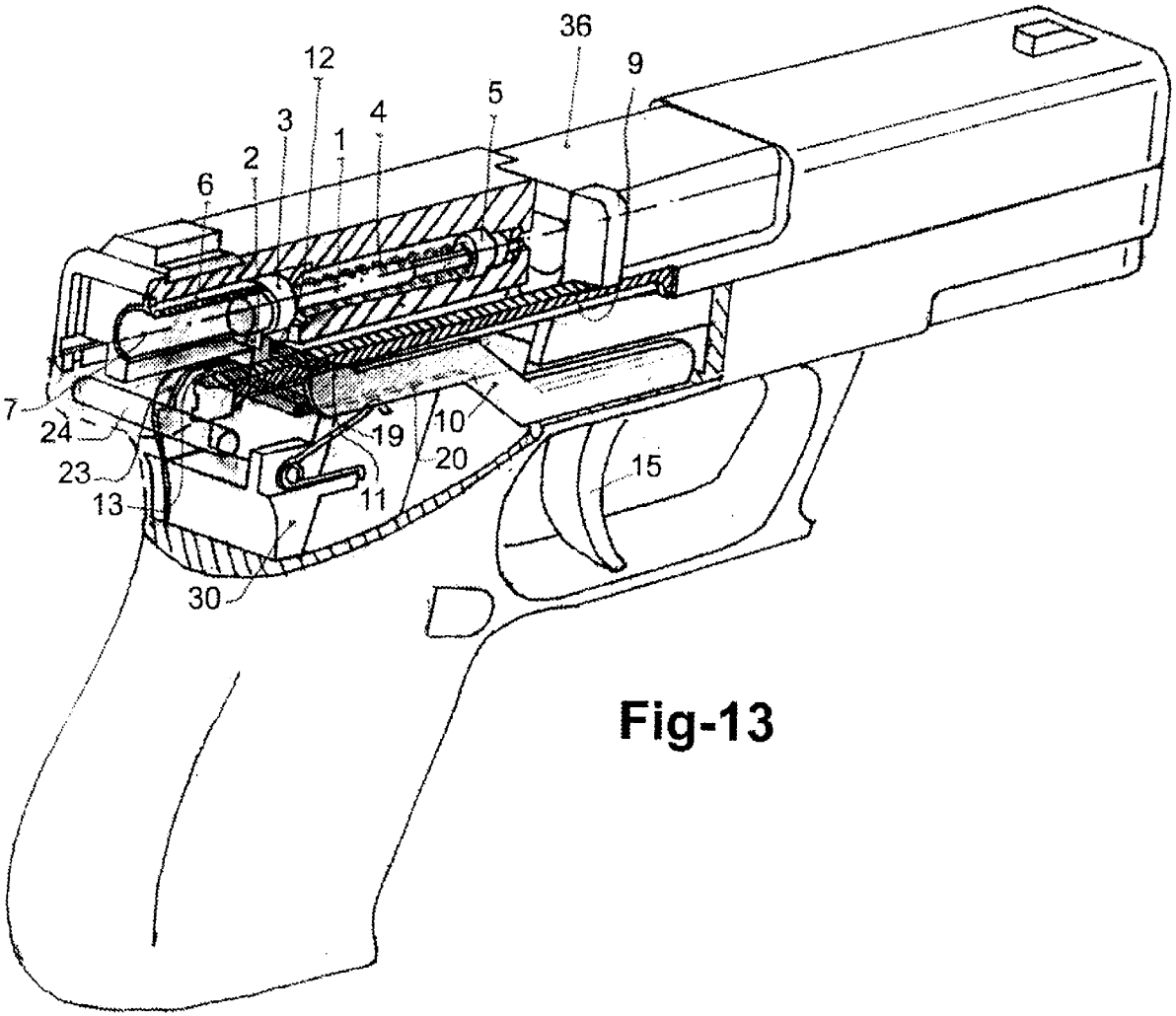

FIG. 13 illustrates an overview of the machine gun with a fragmentary section through the self-loading striker-trigger mechanism.

Figure 14:
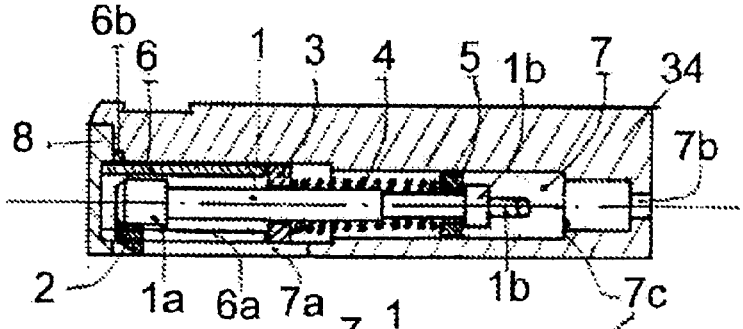
Figure 14:
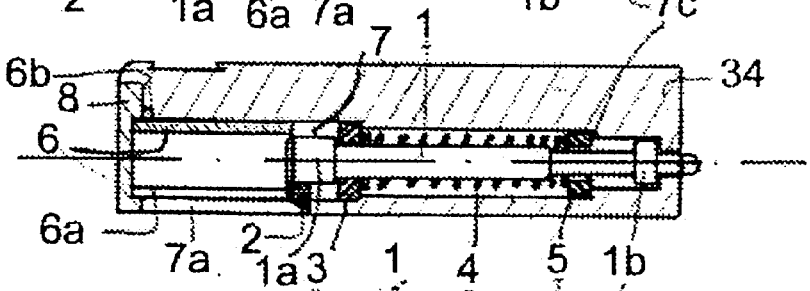
Figure 14:
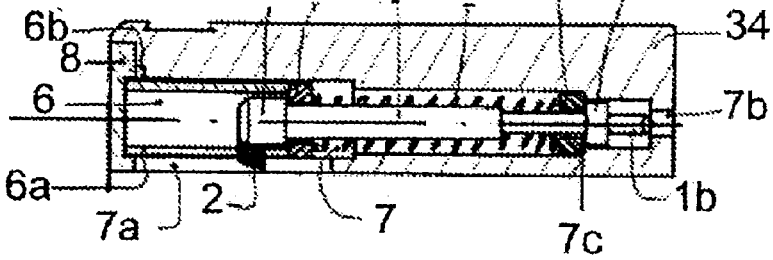

FIG. 14/A displays a vertical section of the striker mechanism in position setting the firing pin in combat readiness.

FIG. 14/B represents a vertical section of the striker mechanism in position operating the firing pin for executing a shot.

FIG. 14/C is a vertical section of the striker mechanism in position returning the firing pin in initial stationary state.

DETAILED DESCRIPTION OF THE INVENTION

Figure 1:
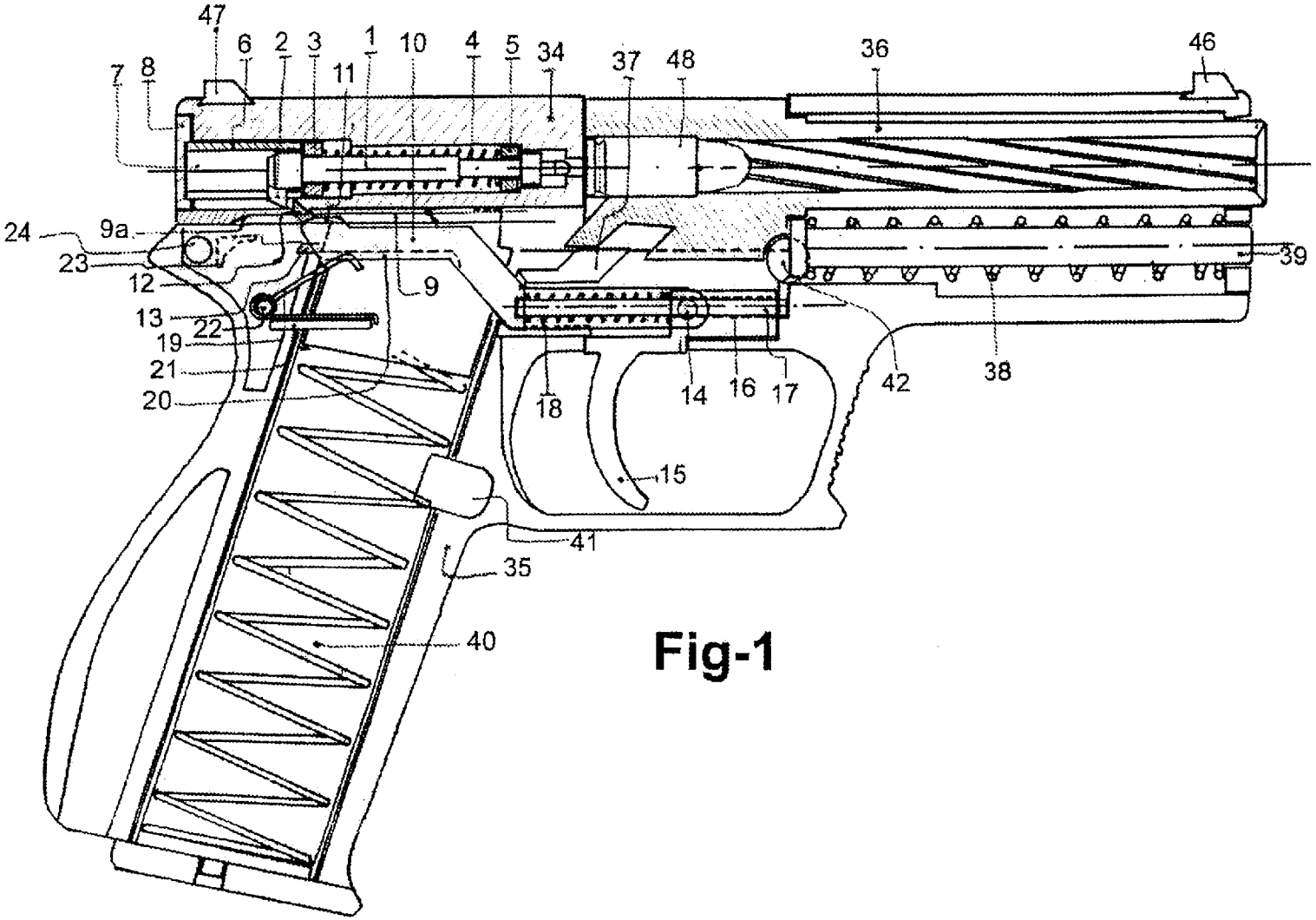

FIG. 1 displays a vertical section of a machine gun, mechanisms stationary, with a built-in self-loading striker-trigger mechanism, as put forward by this invention. Pistol represented machine firing gun consists of a frame 35, to the front of which a barrel 36 is located whose rear end shapes into a cartridge chamber for a cartridge 48 to be fed. Under the barrel 36, in the front part of the frame 35 a helical recoil spring 38 is mounted, coiled around axle 39, at the rear end of which is the pistol dissasembly latch 42. Behind the disassembly latch 42 is the slide lock 37 for the barrel 36, below which is positioned the trigger mechanism linked with a striker mechanism, located backward up in the breach block 34, under which within the frame is the magazine 40 and a magazine lock 41 releasing the magazine 40. Up on the breach block 34 come front 46 and rear 47 sights respectively.

The self-loading striker-trigger mechanism, as per this invention, consists of the kinematically connected one to the other a linking unit accomplished as a rear block 30, striker mechanism, mounted in a breach block 34, trigger mechanism and fire select mechanism in the form of fire select 29 of either automatic or semi-automatic fire mode. The fire select 29 is situated in the rearmost part of the frame 35.

The breach block 34 is installed in the upper part of the frame 35. To the front right-hand part of the breach block 34 an extractor 43 is attached in the form of a two-arm lever with bending front end of one of its arms, leaning on the front foremost surface of the breach block 34. The extractor 43 (shown in FIG. 11) is joint-linked to a stationary axle 44, with the rear end of the second arm of the lever, representing extractor 43 with fastened helical spring 45, running within a channel square to axis 44.

The self-loading trigger mechanism is placed along the axis of the barrel 36, as displayed in FIGS. 1, 14/A, 14/B and 14/C, and consists of a firing pin 1 with enlargements at both ends, that is rear enlargement 1a and front enlargement 1*b*, and a tooth 2 constructed to the lower end of the rear enlargement 1*a* to mesh the firing pin 1 with the trigger mechanism. Tooth 2 has a flat front foremost surface square to the axis of the firing pin 1 and slantwise to the same axis rear surface. In the front part of the firing pin 1, central to the front enlargement comes a pointed end 1*c*. Between the two enlargements 1*a* and 1*b* two axially movable spring cups 3 and 5 are placed, whose internal diameter is less than the external diameter of the enlargements 1*a* and 1*b*, so that their movement along the axis is restricted by them. The two axially movable spring cups 3 and 5 are separated by a volute firing pin spring 4 around the firing pin 1, pressing cups 3 and 5 to their adjacent enlargements 1*a* and 1*b* respectively.

The step-like channel 7 within the breach block 34 has a lengthwise cut-out 7*a*, made to its lower rear part and parallel to its longitudinal axis. This lengthwise cut-out 7*a* takes the tooth 2 of the rear enlargement 1*a* of the firing pin 1, and tooth 2 is positioned so that it can protrude outside the lengthwise cut-out 7*a*. The front part of the step-like channel 7 is constricted into a step-like tightening 7*b*, whose front part is least in diameter and ends in aperture 7*b* for the front pointed end 1*c* of the firing pin 1 to pass through. Behind the rear axially movable cup 3, in the rear largest in diameter part of the step-like channel 7 of the breach block 34 a spacer sleeve 6 is placed to prop movable spring cup 3 upon setting the firing pin 1 into combat position (FIG. 14/A). Sleever 6 has a longitudinal fuller 6*a*, made in the area of the longitudinal cut-out 7*a* in the rear part of the step-like channel 7, accomplished within the breach block 34 and fitting so with it that the tooth 2 of the firing pin 1 can move freely parallel to the longitudinal axis. Sleeve 6's external diameter is equal to the diameter of the rear, widest part of the step-like channel 7, and the internal diameter of this sleeve 6 is a little larger than the rear enlargement 1*a* of the firing pin 1, so that it goes freely through it and the firing pin 1 can move unhindered along the axis. Spacer sleeve 6 is stationary—attached to the rear part of the step-like channel 7 in the breach block 34 by means of a fixing tooth 6*b*.

A lid 8 has been provided in the rear part of the breach block 34 to cover the step-like channel 7 and hence the striker mechanism is contained within it.

The trigger mechanism, demonstrated in FIGS. 1 and 12, consists of trigger 15 suspending from axle 17, fixed to the frame 35 and going through channel 16, made in the upper part of the trigger 15. A volute spring 18 to retain the trigger 15 coiled around axle 17 leans on the rearmost surface of the above referred upper part. Axle 14 is mounted to the upper part of the trigger 15 joint-linked with trigger bar 10 in the form of a profile one-arm lever. The upper rear part of the trigger bar 10 has an arcuated lug 11. The rear aftermost part of the trigger bar 10 in the top has a firing tooth 12 made to engage with tooth 2 of the firing pin 1. The firing tooth 12 has a rear aftermost surface square to the axis of the firing pin 1 and a front slanting surface corresponding with the slanting surface of tooth 2 of the firing pin 1.

The rearmost surface of the trigger bar 10, in the area below the firing tooth 12 there is a tooth 13 to hold the trigger bar 10 in down position in semi-automatic fire mode and with trigger 15 tightly pulled, which takes place via a lamellar retention spring 23 mounted in the cut-out 32 made in the rear block 30. The rear block 30 is located in the rear upper part of the frame 35 and serves to connect the striker and the trigger mechanisms with the fire select mechanism 29 for switching from and to automatic and semi-automatic fire modes. This fire select 29 has an arm 25 with slanting inner surface 26 and attached to axle 24, joint-linked in an aperture in the aftermost part of the frame 35. An upper pitch-bent end of the retention spring 23 leans on the inner slanting surface 26, and the second end of the spring retention 23 is installed in cut-out 32 in the rear block 30. The lower part of the trigger bar 10 parallel to the axis of the firing pin 1, has a longitudinal canal 20 to contain one of the arms of a spring 19 coiled around a stationary axle 22. Under the second arm of spring 19 there is a prop 21 from the frame 35 parallel to the firing pin 1's axis. Spring 19 is meant to push lug 11 from the trigger bar 10 upwards to the inner surface of the ramp-channel 9 with rear slanting surface 9*a*, which is accomplished in the lower rear part of the breach block 34, parallel to the axis of the firing pin 1.

Fire select 29 (shown in FIGS. 9 and 14) for automatic and semi-automatic fire modes is provided with a fixing pin 27 and spring 28, in their turn meant to retain its positions in automatic and semi-automatic fire modes respectively. The rear block 30 has a repeller 33 facing front.

Operation of a Firearm with Built-in self-loading Strikers-trigger Mechanism Explicated A machine gun with built-in self-loading striker-trigger mechanism, as provided by this invention, is loaded by means of manually sliding the breach block 34 into aftermost position and its subsequent releasing to go ahead, thus feeding the rear end of barrel 36 with a cartridge 48.

Then the trigger 15 is pulled, upon which a shot is executed. Under the blow-back (recoil) action of the shot fired the breach block 34 flies ahead ejaculating the case of the fired cartridge 48 through extractor 43. Pushed by the return spring 38, the breach block 34 goes back to fore and selects another cartridge 48 from magazine 40 to feed into barrel 36.

The stationary machine gun mechanisms shown in FIG. 1 render the firing tooth 12 of the trigger bar 10 of the trigger mechanism in position in front of the firing pin 1 tooth 2, thus performing the role of a safety device. In such a case shot cannot be fired.

FIGS. 1 and 13 demonstrate the firing pin spring 4 of the firing pin 1 simultaneously pressing on the rear axially movable spring cup 3 to go backward and the front axially movable spring cup 5 to go forward. So the rear axially movable cup 3 leans on the front foremost surface of sleeve 6, and the front axially movable cup 5 leans on the rear aftermost surface of the step-like tightening 7*b* within the step-like channel 7 of the breach block 34. Thus the two cups, 3 and 5 respectively, press the rear enlargement 1*a* of the firing pin 1 backward, and the front enlargement 1*b* forward, putting it in this way into a stationary position.

To set the machine gun into automatic fire mode the fire select 29 has to be put in upper position, as displayed in FIGS. 9/A, 9/B, 9/C and 9/D. By pulling the trigger 15, the trigger bar 10 moves backward while pressing tooth 2 of the firing pin 1 via its firing tooth 12, thus setting the firing pin into combat position, as in FIGS. 2 and 14/A.

Figure 3:
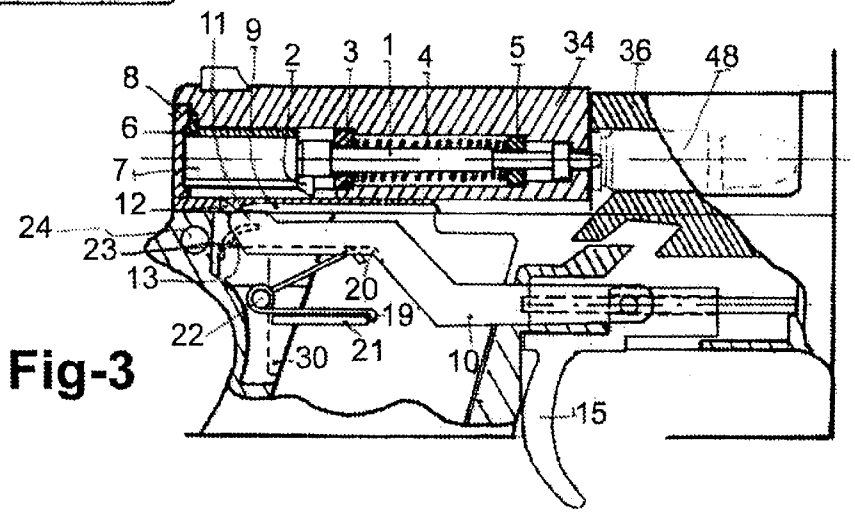

Setting the firing pin 1 into combat position, its front enlargement 1*b* drags the front axially movable cup 5, which presses the firing pin spring 4 and exerts it, pushing it to the leaning on the sleeve 6 rear axially movable cup 3. The firing pin spring 4 cocks until the front end of the arcuated lug 11 of the trigger bar 10, which is moving in the ramp-channel 9 of the breach block 34, slides into the slanting inner rear surface 9*a* of this ramp-channel 9; the sliding makes the trigger bar 10 fall downward and the firing pin tooth 12 releases the profile tooth 2 of the firing pin 1, which under the pressure of the firing pin spring 4 flies forward, as seen in FIG. 3.

Firing pin 1 moving forward by force of the fully cocked firing pin spring 4, it presses on the front spring cup 5, which leans on the front step-like enlargement 1*b* of the firing pin 1, thus moving it forward. The front movable cup 5 stops moving along the axis when leaned on the rear aftermost surface of the step-like tightening 7*b* of channel 7 in the breach block 34. At that the firing pin 1 keeps advancing by inertia. In the last stage of its movement the firing pin 1, via its rear enlargement 1*a* drags the rear axially movable cup 3 and so partially cocks the firing pin spring 4. That is the moment of firing a shot, represented in FIGS. 3 and 14/B. At that point the front enlargement 1*b* of the firing pin 1 is leaning on the step of the tightening 7*c* of channel 7 and the front pointed end of the firing pin 1 protrudes from the aperture 7*b*, so that to strike on the primer of the cartridge 48 chambered in the barrel 36.

The firing pin spring 4, partially cocked, by the impact of the force produced upon its forward contraction, by the inertia of the firing pin 1 moving, presses on the rear axially movable cup 3 backward and moves it to the front foremost surface of sleeve 6, thus returning the firing pin 1 into its initial position, shown in FIG. 14/C and above described as stationary.

After the shot is fired, under the blow-back action of the recoil, the breach block 34 flies backward ejaculating the case of the cartridge shot 48 through the extractor 43. The breach block 34 moving backward, the ramp-channel 9 is positioned above the arcuated lug 11 of the trigger bar 10, which under impact of spring 19 is elevated. On its way back tooth 2 of the firing pin 1 slides on its rear slanting surface down the reversely slanting surface of the firing pin tooth 12 of the trigger bar 10 and leaps over it with the firing pin 1 sustaining its movement back together with the breach block 34, as shown in in FIG. 4. This movement continues until the breach block 34 reaches its aftermost rear position.

Figure 5:
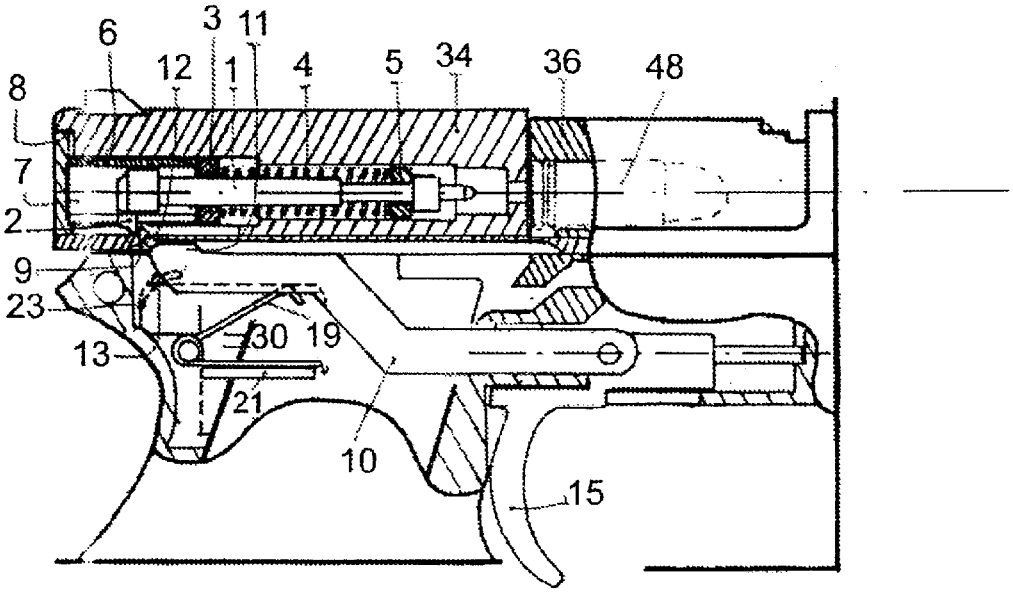

Then, under the impact of the recoil spring 38, the breach block 34 starts forward picking another cartridge 48 from the magazine 40 on its way and feeding it into the chamber of the barrel 36. Upon this advance of the breach block 34 the tooth 2 of the firing pin 1 catches the firing tooth 12 of the trigger bar 10 thus blocking the movement of the firing pin 1 into halt. The breach block 34 keeps moving ahead, cocking the firing pin spring 4, which contracts, as shown in FIG. 5. This contraction of the firing pin spring continues until the inner slanting surface 9*a* of the ramp-channel 9 leans on the arcuated lug 11 of the trigger bar 10 pressing it downward. Thus the firing tooth 12 of the trigger bar 10 releases the profile tooth 2 of the firing pin 1 and that flies ahead under impact from the firing pin spring 4; in the final stage of its way it drags the axially movable cup 3, partially cocking the firing spring 4 at that, contracting it until the front pointed end 1*c* of the firing pin 1 hits the primer of the cartridge 48, upon which a shot is fired (demonstrated in FIG. 6).

Figure 6:
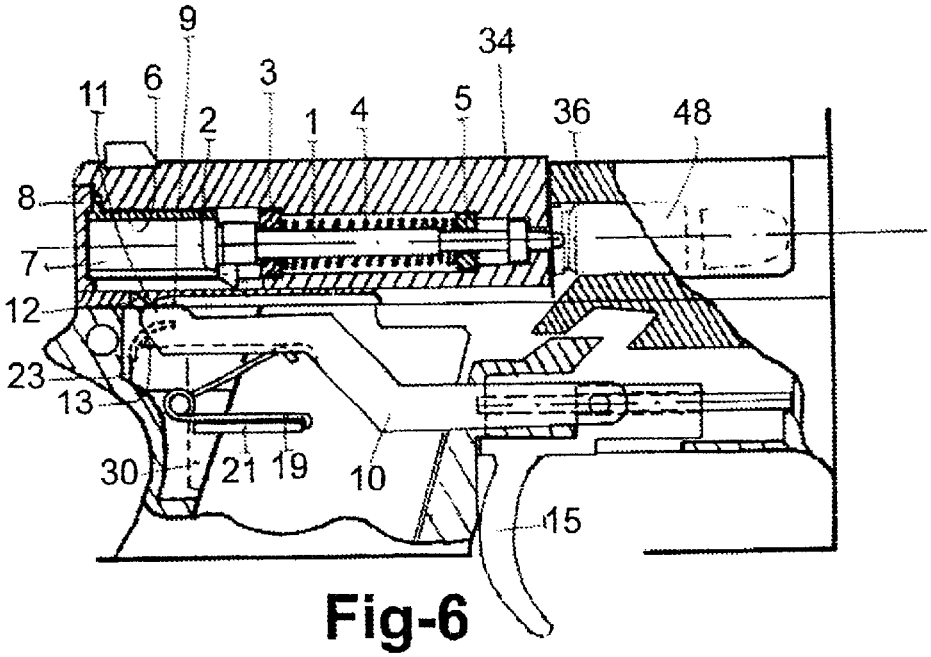
FIG. 6 shows a partial vertical section of part of the machine gun through the self-loading striker-trigger mechanism in foremost front position of the breach block the moment an automatic shot is being fired, trigger pulled.

At the point of releasing the firing pin 1 the breach block has reached its foremost front position, shown in FIG. 6.

Figure 4:
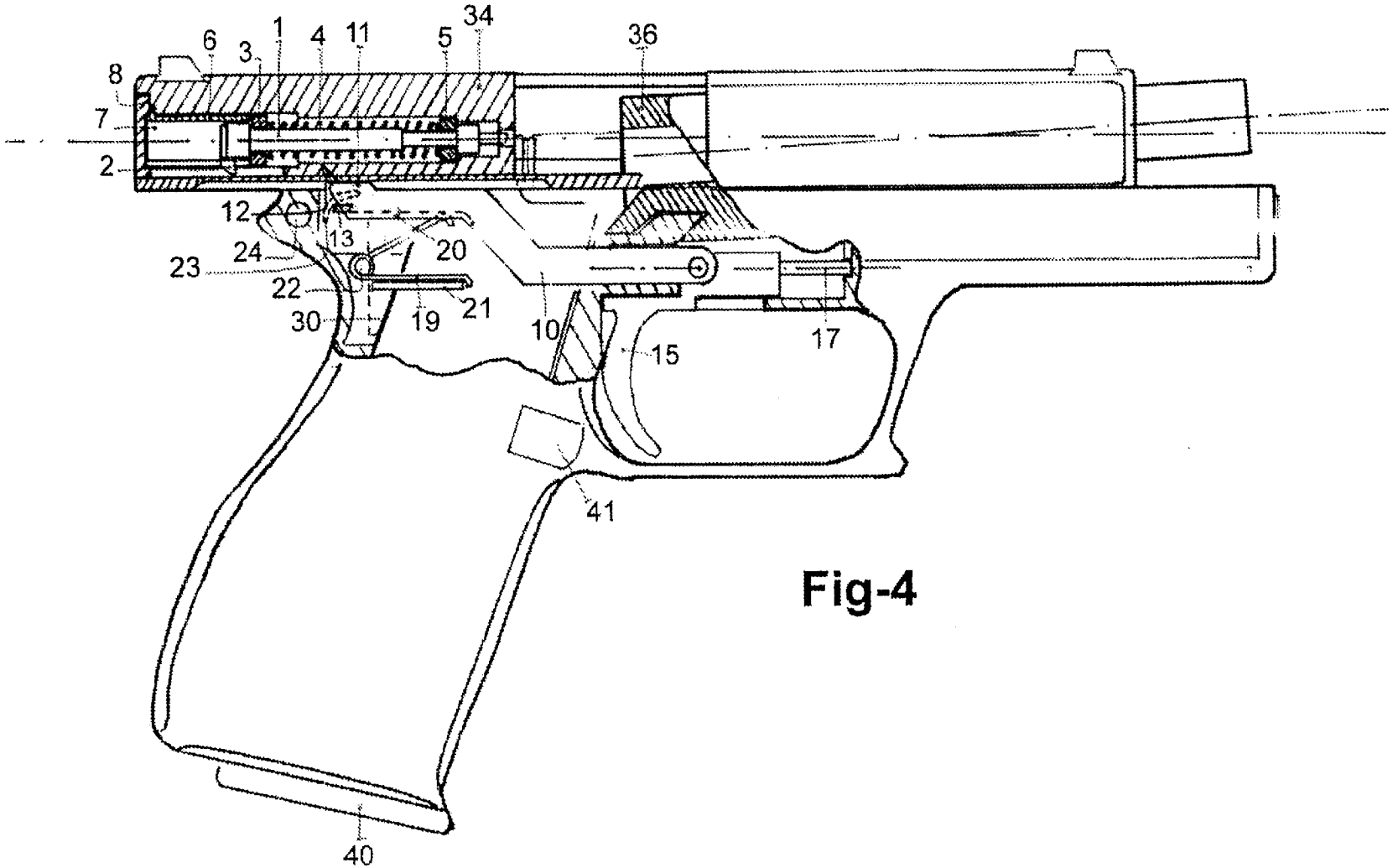

The blow-back (recoil) action after shooting causes the breach block 34 again to fly backward ejecting the case (FIG. 4).

The above described sequentially repeats until the trigger 15 is relieved. Then, the trigger 15 released, the breach block 34 resumes its foremost front position, but the slanting surface 9a of the ramp-channel does not reach the arcuated lug 11 of the trigger bar 10 and does not press it downward. So the lug 11, under impact of spring 19 remains elevated, hence the firing tooth 12 of the trigger bar 10 and the tooth 2 of the firing pin 1 remain engaged and the automatic fire ceases. This coincides with the stationary position shown in FIG. 1.

Figure 2:
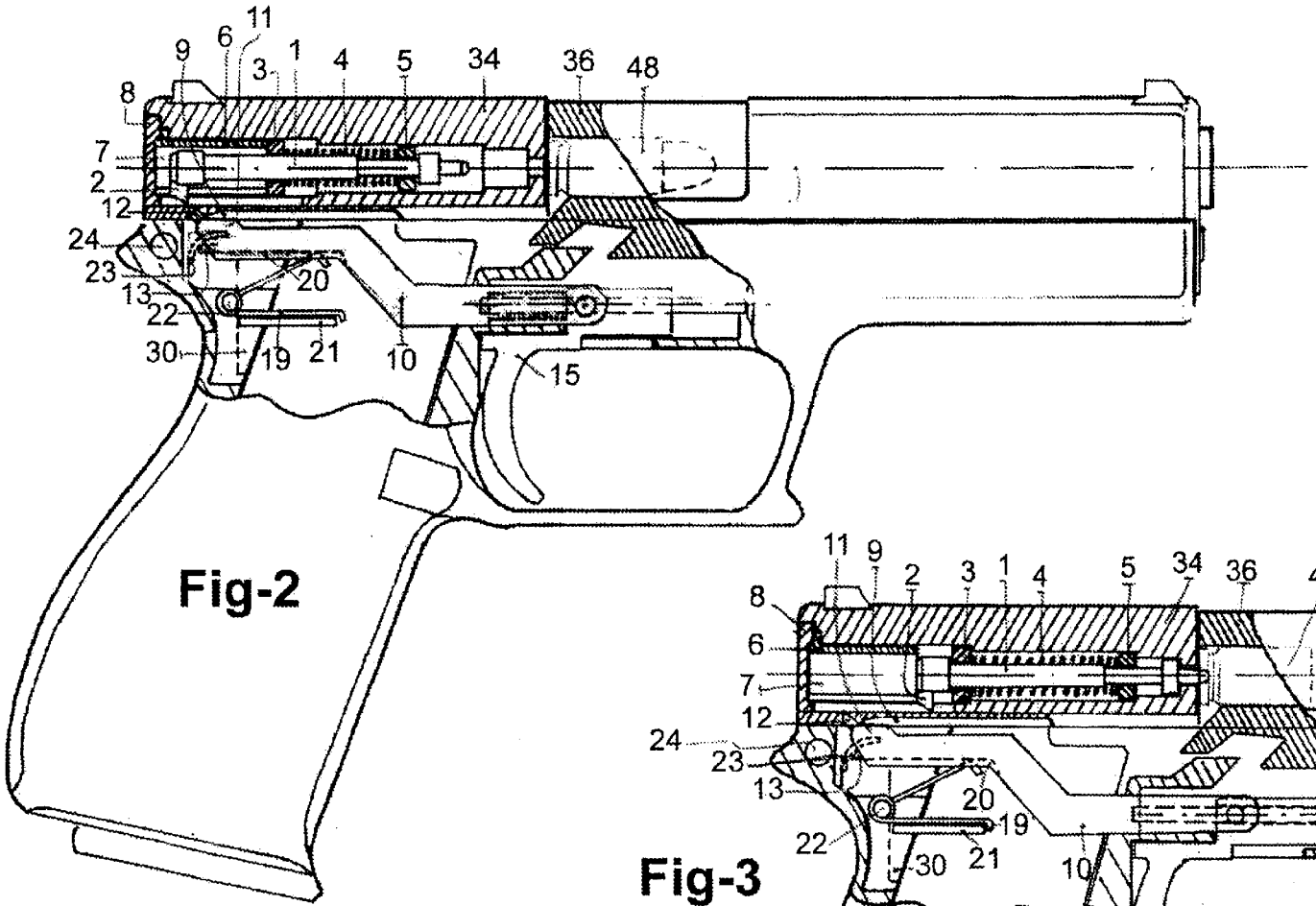

Pressing the trigger 15 again, as displayed in FIG. 2, the automatic fire proceeds until the trigger 15 is released again.

For semi-automatic mode of operation of the machine firearm the fire select 29 is lowered, as seen in FIGS. 10/A, 10/B, 10/C and 10/D. Hence the recoil spring 23 hinders the way of tooth 13 for retaining the trigger bar 10 in lower position.

Pulling the trigger 15, the trigger bar 10 moves together with it backward and drags the firing pin 1, because the firing tooth 12 of the trigger bar 10 is meshed in the tooth 2 of the firing pin and via the front axially movable cup 5 contracts the firing pin spring until the arcuated lug 11, moving along the ramp-channel 9 of the breach block 34 slides into its inner slanting surface 9*a*, thus causing the trigger bar to drop downward. At that the firing tooth 12 of the trigger bar 10 releases the firing pin, as shown in FIG. 2 and that under impact of the firing pin spring 4 flies ahead, to drag in the final stage of its way the rear movable cup 3 and partially exerts the firing pin spring 4 contracting it until the front pointed end 1*c* of the firing pin 1 hits the primer of the cartridge 48. Thus a shot is fired and that is seen in FIG. 3.

Figure 7:
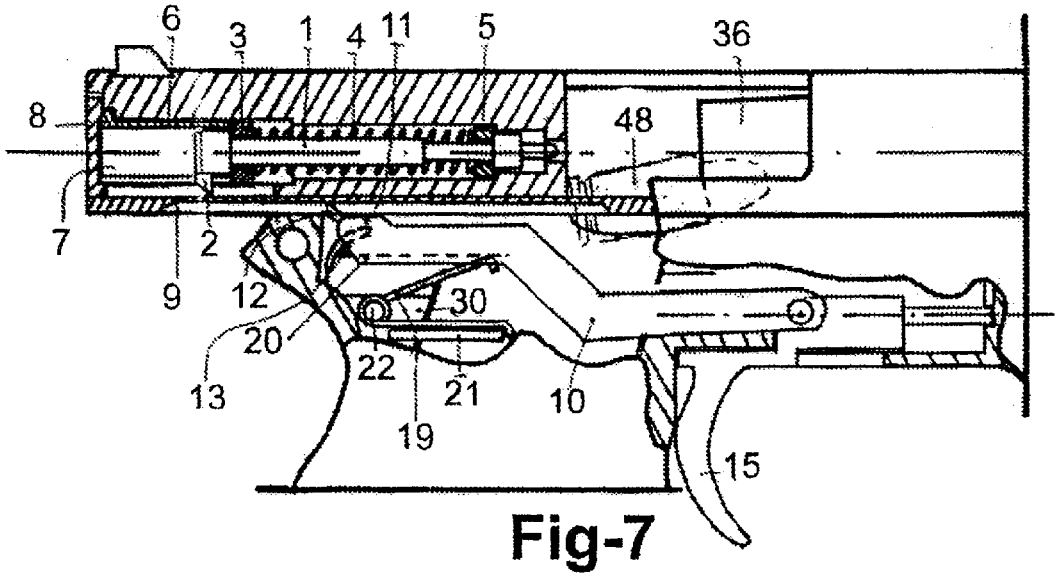
FIG. 7 represents a partial vertical section of part of the machine gun through the self-loading striker-trigger mechanism at the moment of reloading in semi-automatic fire mode.

The blow-back (recoil) action after executing a shot causes the breach block 34 to fly backward, extractor 43 dispensing of the case. At that point the firing pin 4, via the rear movable cup 3 returns the firing pin into its initial position. Simultaneously the breach block 34, under impact of the return spring 38, located in the area below the barrel 36 resumes its starting position ahead, picking another cartridge 48 on its way from the magazine 40 and feeding that into the barrel 36. Upon that movement ahead of the breach block 34, the firing tooth 12 of the trigger bar 10 does not engage with tooth 2 of the firing pin 1, as the trigger bar 10 remains in its lower position locked by the meshing of tooth 13 of this trigger bar 10 and the recoil spring 23, as shown in FIGS. 7 and 8.

Figure 8:
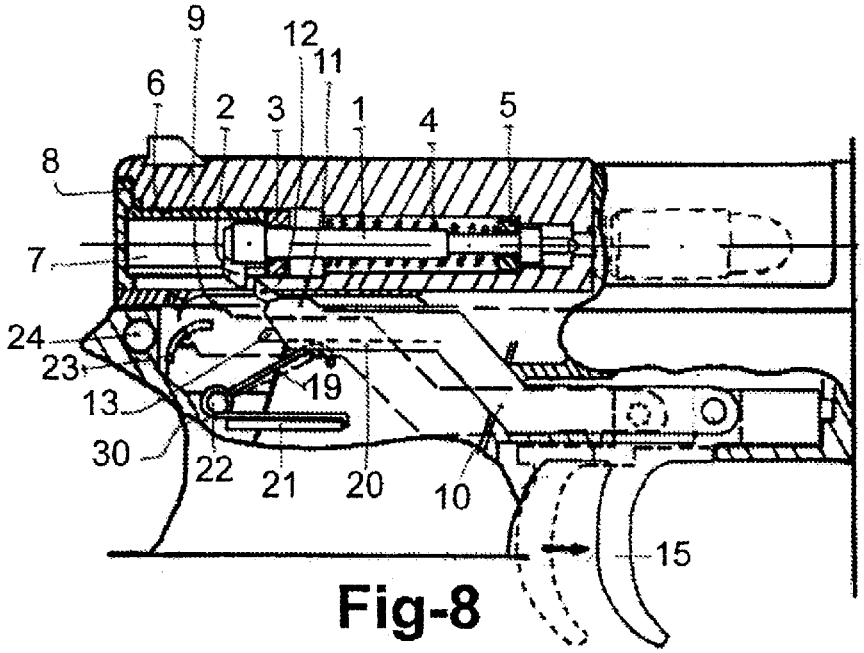
FIG. 8 is a partial vertical section of part of the machine gun through the self-loading striker-trigger mechanism after reloading in combat position.

To produce another shot the trigger 15 has to be released, and under impact of spring 18 for trigger 15 return, get back into front foremost position, on its way the firing tooth 12 of the trigger bar 10 slides on its rear slanting surface into the reversely slanting respective surface of tooth 2 of the firing pin 1, thus leaping over and in front of it and again resuming initial combat position—demonstrated in FIG. 8. All the time the spring 19 is pressing the trigger bar 10 upward to the lower surface of the firing pin 1.

For subsequent shooting the trigger 15 has again to be pressed, as seen in FIG. 2, with the entire above described sequence repeated.

List of Positions from Supplemented Drawings

1. Firing pin
1A. rear enlargement of the firing pin 1
1B. front enlargement of the firing pin 1
1C. pointed end of the firing pin 1
2. Firing pin 1 tooth
3. Rear spring cup
4. Firing pin spring
5. Front spring cup
6. Spacer sleeve
6A. lengthwise fuller of sleeve 6
6B. fixing tooth/pin of sleeve 6
7. Step-like channel
7A. longitudinal cut-out of the step-like channel 7
7B. front aperture of the step-like channel 7
7C. step-like tightening of the step-like channel 7
8. Lid covering the step-like channel 7
9. Ramp-channel
9A. slanting surface of the ramp-channel 9
10. Trigger bar
11. arcuated lug of the trigger bar 10
12. firing tooth of the trigger bar 10
13. retention tooth of the trigger bar 10
14. axle for joint-linking the trigger bar 10 to the trigger 15
15 Trigger
16. trigger axle canal 15
17. trigger 15 axle
18. trigger 15 return spring
19. trigger bar 10 impact spring
20. trigger bar 10 groove for spring 19
21. Lower spring 19 prop
22. Spring 19 axle
23. Trigger bar 10 retention spring for semi-automatic fire
24. Fire select 29 axle
25. Fire select 29 arm
26. Inner slanting surface of fire select 29
27. Fire select 29 fixing pin
28. Fixing pin 27 spring
29. Fire select
30. Rear block
31. Rear block 30 fixing pin
32. Spring retention 23 groove
33. Repeller
34. Breach block
35. Machine firearm frame
36. Chambered barrel
37.Sliding barrel 36 lock
38. Recoil spring
39. Recoil spring 38 axle
40. Magazine
41 Magazine 40 catch
42. Pistol disassembly lock
43. Extractor
44. Extractor 43 axle
45. Extractor 43 axle
46. Front sight
47. Rear sight
48. Cartridge

What is claimed is:

1. A striker-trigger mechanism for full automatic and semiautomatic firearms having a connected striker mechanism, a trigger mechanism, and a fire selecting mechanism for switching to and from automatic and semi-automatic fire modes; with the striker mechanism including a firing pin mounted within a breach block, itself positioned in an upper rear end of a frame of a gun, the firing pin having a front pointed end and a firing pin spring coiled around it; and the trigger mechanism located below that having a trigger to set the firing pin into combat position; characterized in that:

the firing pin (1) of the striker mechanism has enlargements at both ends, respectively a rear enlargement (1*a*) and a front enlargement (1*b*) with a lower end of the rear enlargement (1*a*) having a profile tooth (2), meshing with a firing tooth (12) and with the trigger mechanism, profiles of the firing tooth (12) and the profile tooth (2) corresponding with each other, and centrally to the front enlargement (1*b*) of the firing pin (1) with its end pointed (1*c*);

between the rear and front enlargements (1*a* and 1*b*), two axially movable spring cups (3 and 5) are placed with external diameters measuring more and internal diameters measuring less than an external diameter of the rear and front enlargements (1*a* and 1*b*), so that their axial movement is restricted between the enlargements;

the two axially movable spring cups (3 and 5) are separated by a helical firing pin spring (4) coiled around the firing pin (1), the firing pin spring being less in diameter than the external diameter of the cups (3 and 5), thus pressing them to their respectively adjacent enlargements (1*a* and 1*b*); and a unit striker mechanism mounted in a step-like channel (7) made in the rear central part of a breach block (34) along the same axis as the gun's barrel (36), the step-like channel (7) having a lid (8) housing rear and front props for restricting the axial movements of the movable cups (3 and 5).

2. The striker-trigger mechanism for full and semiautomatic firearms of claim 1, characterized in that:

the step-like channel (7) in the breach block (34) has a lengthwise cut-out (7*a*), in a lower rear part, parallel to its longitudinal axis, in which the profile tooth (2) is made to the rear enlargement (1*a*) of the firing pin (1), so that it protrudes outside the lengthwise cut-out (7*a*), and the step-like channel (7) is constricted in its front part to form a step-like tightening (7*c*), whose foremost surface is the front prop for the movable spring cup (5) in its front foremost position and in its front part, the step-like channel (7) is least in diameter and ends in an aperture (7*b*) for the front pointed end (1*c*) of the firing pin (1) to come through, and in its rear part, maximal in diameter;

the stationary rear prop for the spring cup (3) is positioned in the form of a sleeve (6), which in the area of the lengthwise cut-out (7*a*) has a lengthwise fuller (6*a*) as wide as the lengthwise cut-out (7*a*) and fitting with it so that the firing pin (1) tooth (2) can move easily parallel to its longitudinal axis, and the sleeve's (6) outside diameter is equal to the diameter of the rear, widest part of the step-like channel (7), while the inside diameter of this sleeve (6) is a little larger than the rear enlargement (1*a*) of the firing pin (1), so that it can easily pass through it and the firing pin (1) can easily move along its axis.

3. The striker trigger mechanism for full automatic and semiautomatic firearms of claim 2, characterized in that the sleeve (6) is fixed stationary in the rear part of the step-like channel (7), within the breach block (34) by means of a fixing pin (6*b*).

4. The striker-trigger mechanism for full automatic and semiautomatic firearms of claim 1 characterized in that the profile tooth (2) of the firing pin (1) is designed with a flat front foremost surface, square to the axis of the firing pin (1) and slanting to this axis rear surface, while the firing tooth (12) has a flat rear aftermost surface, also square to the axis of the firing pin (1) and slanting front surface, corresponding to the slanting surface of the tooth (2).

5. The striker-trigger mechanism for full automatic and semiautomatic firearms of claim 1 further comprising a trigger mechanism spring (19) made from spring wire that coils around a stationary axis (22) installed in a rear block (30), with one arm of the spring (19) pressed to the lower, parallel axis of the firing pin (1) part of the trigger bar (1) and situated in a lengthwise groove (20), and below the second arm of the spring (19) a prop (21) is provided as part of the rear block (30), parallel to the axis of the firing pin (1), so that it can press upon the trigger bar (10) upward to the inner surface of a ramp-channel (9) with rear slanting surface (9*a*), made in the lower rear part of the breach block (34), parallel to the firing pin (1) axis.

6. The striker-trigger mechanism for full automatic and semiautomatic firearms of claim 5 characterized in that the rear block (30) is located in the upper rear part of the frame (35) and has the fire select (29) of fire mode attached to it by means of an arc (25), with an inner slanting surface (26) with learning to it, upper bent end of the spring retention (23), the second arm, of which is mounted in a cut-out (32) made in the rear part of the rear block (30), with the arm (25) joint-linked to an axle (24) fastened in the rearmost part of the frame (35) and is in contact with a fixing pin and a spring (27, 28).

7. The self-loading striker-trigger mechanism for machine and submachine firearms, as per claims 1, characterised with that the trigger (15) is suspended from an axle (17) attached to the frame (35) and passes through a channel (16) made in the upper part of the trigger (15), while the volute spring (18) for returning the trigger (15) coiled around the axle (17) is leaning on the front foremost surface of the above mentioned part; the upper part of the trigger (15) at that has an axle (14) installed to joint-link with the trigger bar (10) in the upper rear part also containing the arcuated lug (11) and the firing tooth (12) designed with the rear foremost surface of the trigger bar (10); a retention tooth (13) is provided working via a retention spring (23), located in the rear block (30).

8. The self-loading striker-trigger mechanism for machine and submachine firearms, as per claims 1, characterised with that the rear block (30) is located in the upper rear part of the frame (35) and has the fire select (29) of fire mode attached to it by means of an ar (25) with inner slanting surface (26) with leaning to it upper bent end of the spring retention (23), the second arm of which is mounted in a cut-out (32) made in the rear part of the rear block (30), with the arm (25) joint-linked to an axle (24) fastened in the rearmost part of the frame (35) and is in contact with a fixing pin and a spring (27, 28).

* * * * *